US006148720A

United States Patent [19]

Yoshida

[11] Patent Number: 6,148,720

[45] Date of Patent: Nov. 21, 2000

[54] PRESS MACHINE

[75] Inventor: Akihiro Yoshida, Gifu-ken, Japan

[73] Assignee: Kabushiki Kaisha Yamada Dobby, Japan

[21] Appl. No.: 09/326,165

[22] Filed: Jun. 4, 1999

[30] Foreign Application Priority Data

Jul. 17, 1998 [JP] Japan ..... 10-203287
Mar. 24, 1999 [JP] Japan ..... 11-079538

[51] Int. Cl.[7] ..... B30B 5/00; B30B 1/02

[52] U.S. Cl. ..... 100/257; 100/283; 72/451

[58] Field of Search ..... 100/282, 283, 100/285, 257; 72/450, 451; 83/626

[56] References Cited

U.S. PATENT DOCUMENTS

| | | | |
|---|---|---|---|
| 2,562,044 | 7/1951 | Klocke | 100/283 |
| 3,785,282 | 1/1974 | Kamelander . | |
| 3,791,191 | 2/1974 | Baldyga | 72/451 |
| 4,434,646 | 3/1984 | Maeda et al. | 72/451 |
| 5,287,728 | 2/1994 | Yoshida . | |
| 6,012,322 | 1/2000 | Itakura | 100/285 |

FOREIGN PATENT DOCUMENTS

| | | |
|---|---|---|
| 0 838 328 A2 | 4/1998 | European Pat. Off. . |
| 09225686 | 9/1997 | Japan . |
| 410366 | 5/1934 | United Kingdom . |

*Primary Examiner*—Peter Vo
*Assistant Examiner*—Louis L. Huynh
*Attorney, Agent, or Firm*—ipsolon, LLP

[57] ABSTRACT

A press machine includes a frame, a first crankshaft rotated by a driving source, a second crankshaft connected with a slide, and a connection mechanism provided with a pair of levers connected with each other so as to carry out their bending-stretching motion as the first crankshaft is rotated. One lever has a first pivot and is connected, through the first pivot, with a position adjusting device for adjusting the position of the first pivot in the vertical or horizontal direction. The other lever has a second pivot and is connected, through the second pivot, with the eccentric shaft portion of the second crankshaft. The slide is connected with other eccentric shaft portion of the second crankshaft.

8 Claims, 7 Drawing Sheets

PRESS MACHINE

BACKGROUND OF THE INVENTION

1. Field of the Invention

The present invention relates to a press machine of the class in which the first and second crankshafts are connected with each other by means of a connection mechanism including a pair of links.

2. Prior Art

Press machines using a link mechanism such as a knuckle joint, a toggle joint and so forth, are already known to the public. For instance, an example of such is disclosed by the Japanese Patent Appln. Public Disclosure (KOKAI) No. 9-225686. This press machine includes a first crankshaft rotated by a driving source and a second crankshaft connected with a slide. These crankshafts are connected with each other by means of a connection mechanism using three of links.

In the prior art press machines of this kind, however, the stroke of a slide motion in the up and down directions is limited to a preset value determined depending on the sorts of press processings such as the precise press processing (low speed press processing), the stamping processing (high speed press processing) and so forth.

Consequently, in the prior art press machine of this kind, the stroke of the slide can not be changed, so that the applicable range of the press machine has been limited by such limited stroke of the slide.

Therefore, in the press machine of this kind, it is important that the stroke of its slide motion in the up and down directions be made variable.

SUMMARY OF THE INVENTION

According to the invention, a press machine includes a frame; a first crankshaft rotated by a driving source; a connection mechanism having a pair of levers which are connected with each other and can perform their bending-stretching motion as the first crankshaft is rotated, one of the levers having a first pivot which is not moved by the bending-stretching motion and the other having a second pivot which is moved by the bending-stretching motion; a second crankshaft having the first eccentric shaft portion connected with said second pivot and the second eccentric shaft portion connected with a slide; and a position adjusting device for adjusting position of said first pivot in the up and down directions or in the horizontal direction.

Both of the levers are repetitively bent and stretched as the first crankshaft is rotated. This bending-stretching motion by both levers causes the second crankshaft to swing, which in turn causes the slide to reciprocate in the up and down directions. If the position of the first pivot is changed in the vertical or horizontal direction, the bending position and the bending angle of both levers are changed correspondingly, thus changing the swinging position and the swinging angle of the second crankshaft following the rotation of the first crankshaft. As a result, there occurs a change in the stroke of the slide motion in the up and down directions.

As described above, if there is provided a position adjustment device which can adjust the vertical or horizontal position of the first pivot, the stroke of the slide motion in the up and down directions can be changed in compliance with the sort of the press processing.

The position adjusting mechanism may include a rotating body in the form of a circular plate, the rotating body being provided with a threaded hole and being disposed on the frame so as to rotate about an axis extending in the vertical or horizontal direction but to rotate neither in the vertical direction nor in the horizontal direction, a rotation mechanism for rotating the rotating body, and a moving body disposed on the frame so as to move in the vertical direction. This moving body is pivotally connected with the first pivot and has a male threaded portion capable of mating with the threaded hole. With the position adjusting mechanism, the position of the moving body can be finely adjusted in the vertical or horizontal direction, so that the stroke of the slide motion in the up and down directions can be finely adjusted.

However, the position adjusting mechanism or device may include a rotating body pivotally connected with the connection mechanism such that the pivotal joint to the connection mechanism may rotate about an axis extending in one direction, preferably about an axis in parallel with the axis of the joint of both levers, and a rotation mechanism for rotating the rotating body. In this way, the pivotal joint can be displaced as the rotating body is rotated by the rotation mechanism, thus enabling the stroke of the slide motion in the up and down directions to be finely adjusted.

A press machine may further include a link for connecting the eccentric shaft portion of the first crankshaft with the connection mechanism in order to transmit the rotary motion of the first crankshaft to the connection mechanism. The link may be pivotally connected with the connection mechanism through the joint point between both levers of the connection mechanism or through a point apart from the joint point. The position adjusting device includes a rotating body pivotally connected with at least one lever of the connection mechanism, and a rotation mechanism for rotating the rotating body. The rotation center of the rotating body can be placed at the joint center of both the levers of the connection mechanism, or in the vicinity of the joint center, or at a point apart from the joint center.

Under the situation in which the link is pivotally connected with the joint of both levers or in its vicinity, and the slide is set on the position of the lower dead point, if the rotating body is angularly rotated by the driving mechanism, the rotating body is angularly rotated about the joint between both levers or the vicinity thereof, and the bent position and bent angle of both levers are changed. With this, the swinging position and swinging angle of the second crankshaft is changed as the first crankshaft is rotated. However, any change would be hardly caused with respect to not only the position of the joint between both levers but also the position of the lower dead point. As a result, it becomes possible not only to finely adjust the stroke of the slide motion in the up and down directions, but also to keep the position of the lower dead point almost unchanged even if the stroke is changed.

Contrary to the above, under the situation in which the link is connected with the connection mechanism at a point apart from the joint of both levers, if the rotating body is angularly rotated by the rotation mechanism, the rotating body is angularly rotated about a point apart from the joint of both levers, and the joint point between the rotating body and the connection mechanism is angularly moved in the same or opposite direction. As a result, it becomes possible not only to finely adjust the stroke of the slide motion in the up and down directions, but also to make the positional change of the lower dead point smaller even if the stroke is changed.

The joint portion of both levers can be connected with the eccentric shaft portion of the first crankshaft. With this, comparing to the case where any other portion than the above joint portion is connected with the eccentric shaft portion of the first crankshaft, the momentum of the bending-stretching motion by both levers can be made larger, and the stroke of the slide motion in the up and down directions can be made variable over a wider range.

The first pivot of the one lever can be pivotally connected with the position adjusting device. With this, as the vertical or horizontal position of the first pivot can be directly adjusted by the position adjusting device, it becomes easier to adjust the vertical or horizontal position of the first pivot.

The press machine may further include a link for connecting the eccentric shaft portion of the first crankshaft with the connection mechanism, in order to transmit the rotary motion of the first crankshaft to the connection mechanism.

The press machine may further include one or more rods extended in the up and down directions and arranged on the frame such that they can move in the longitudinal direction of the frame but can not move in the horizontal direction, and a connecting body pivotally connected with the rods and the second eccentric shaft portion of the second crankshaft. The slide can be connected with the rods through lower ends thereof.

In the preferred embodiment, the rotating body in the position adjusting device includes a worm wheel, while the rotation mechanism includes a worm in mesh with the worm wheel and a sprocket fitted to the worm.

PREFERRED EMBODIMENTS OF THE INVENTION

Figure 1:
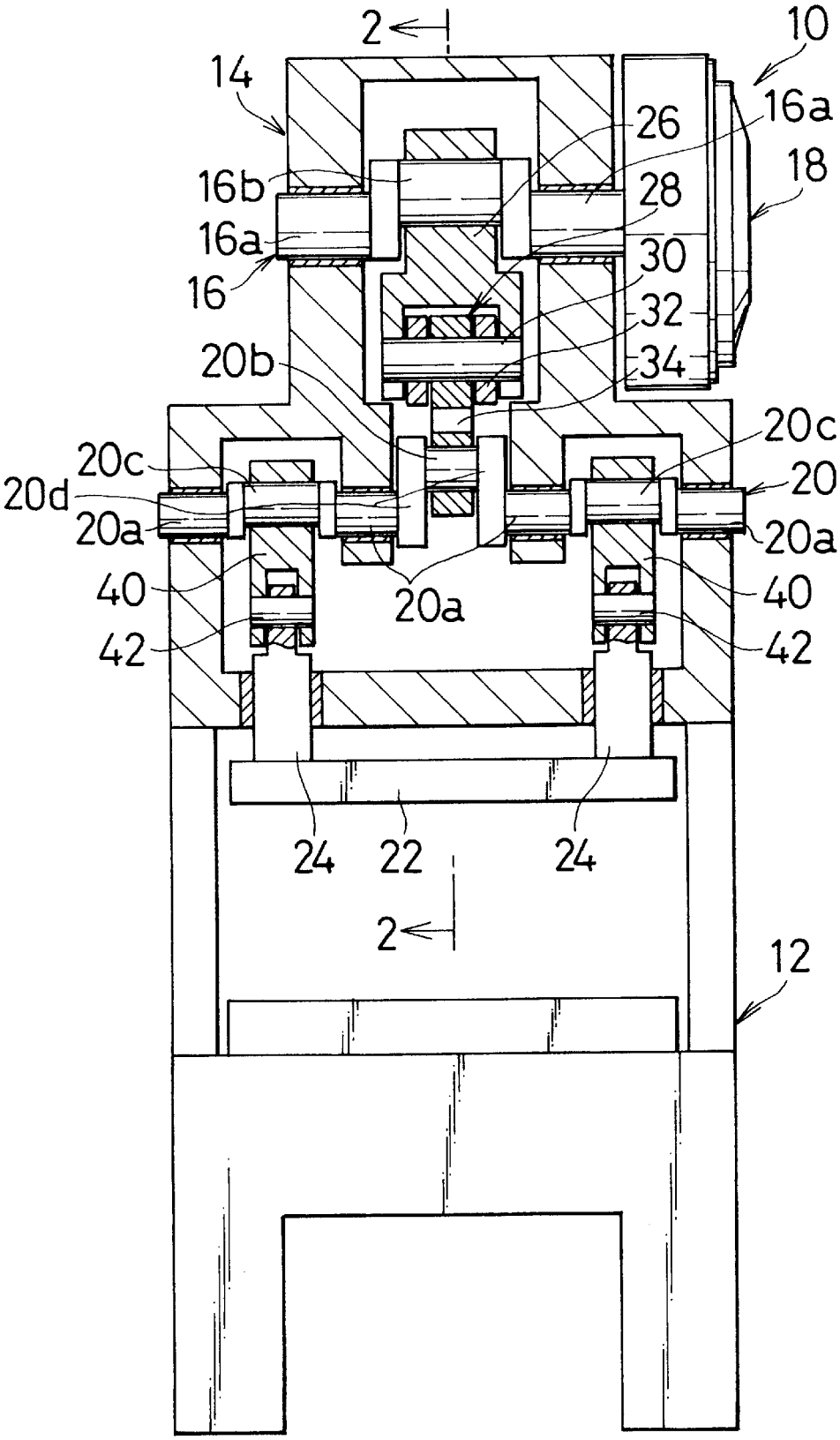
FIG. 1 is an elevational view, partly in section, of a press machine according to an embodiment of the invention.

Referring now to FIGS. 1 through 4, a press machine 10 includes a lower frame 12 on which a lower die is mounted, and an upper frame 14 supported on the lower frame 12.

The first crankshaft 16 is supported by the upper frame 14 such that it can rotate about an axis extending through the upper frame 14 in the horizontal direction. The crankshaft 16 supports at its one end a flywheel 18 which is provided with a mechanism of deceleration. This crankshaft 16 also includes a plurality of principal shaft portions 16*a* which are supported by the frame 14, and an eccentric shaft portion 16*b* which is formed between two principal shaft portions 16*a*.

The second crankshaft 20 is arranged obliquely downward relative to the first crankshaft 16 so as to rotate about an axis extending through the upper frame 14 in the horizontal direction. The second crankshaft 20 includes a plurality of principal shaft portions 20*a* supported by the upper frame 14, a first eccentric shaft portion 20*b* located at the center of the second crankshaft 20, two second eccentric shaft portions 20*c* located on both sides of the first eccentric shaft portion 20*b*, and two arm portions 20*d* which connect the first eccentric shaft portion 20*b* with the principal shaft portions 20*a*, respectively.

Alternatively, the above second crankshaft 20 may be constructed by using two crankshaft units, each including two principal shaft portions 20*a*, a second eccentric shaft portion 20*c* formed between the two principal shaft portions 20*a*, and an arm portion 20*d*. The second crankshaft 20 can also be put together by eccentrically and symmetrically connecting the arm portion 20*d* of each crankshaft unit with the both ends of the first eccentric shaft portion 20*b* and then pivotally connecting the first eccentric shaft portion 20*b* with the other end portion of a lever 34.

A slide 22 to which the upper die is attached, is set up at the lower ends of a pair of rods 24 which can move up and down, penetrating through the lower portion of the upper frame 14.

The eccentric shaft portion 16*b* of the first crankshaft 16 and the first eccentric shaft portion 20*b* of the second crankshaft 20 are connected with each other by means of a link 26 and a connection device or connection mechanism 28. The connection mechanism 28 is provided with a pair of levers 32 and 34, of which respective one ends are connected with each other through a shaft or pivot 30 so as to carry out the bending-stretching motion about the pivot 30. The pivot 30 connects the link 26 with both of levers 32 and 34.

The other end of the lever 32 is pivotally connected with a position adjusting mechanism or position adjusting device 38 through a shaft or pivot 36. The other end of the lever 34 is also pivotally connected with the first eccentric shaft portion 20*b* of the second crankshaft 20. Consequently, the levers 32 and 34 are bent in the form of a mountain having its peak at the pivot 30.

Each of the second eccentric shaft portions 20*c* is pivotally connected with one end of a connection piece 40 which functions as a connecting body. The other end of the connection piece 40 is pivotally connected with the upper end of the rod 24 through a shaft or pivot 42.

The position adjusting device 38 is a device capable of adjusting the vertical height (designated as A in FIGS. 2 or B in FIG. 3) of the first pivot of the connection mechanism 28. In an example as shown, the position adjusting device 38 includes a moving body 44 which is arranged on the upper frame 14 so as to move in the up and down directions, a worm wheel 46 which functions as a rotational body or rotating body, a worm 48 which is in mesh with the worm wheel 46, and a sprocket 50 which is fitted to the worm 48.

The moving body 44 has a male screw 52 which extends downward from its principal part. The rotating body i.e. the worm wheel 46 is supported by the frame 14 such that it is allowed to turn about the axis extending in the up and down directions but it is allowed neither to move in the two dimensional horizontal plane nor to move in the up and down directions. The worm wheel 46 further includes a threaded hole with which the male screw 52 of the moving body 44 can mate.

In the position adjustment device 38, as the sprocket 50 is rotated, the worm 48 is rotated, which in turn enables the worm wheel 46 in mesh with the worm 48 to rotate. With this, the moving body 44 having the male screw, 52 which mates with the threaded hole of the worm wheel 46, can be moved up or down, so that the height of the pivot 36 i.e. the first pivot can be changed.

In this case, in place of the worm wheel 46, there may be employed a flat plate-like rotating body such as a gear, a ratchet wheel, a sprocket, a timing pulley and so forth. Also, depending on the sort of the rotating body, the worm 48 and the sprocket 50 may be replaced by a rotation mechanism including other members such as a ratchet, a chain, a timing pulley, a timing belt and so forth.

The first and second crankshafts 16 and 20, and the shafts 30, 36 and 42 are arranged to extend in parallel with each other. Therefore, the principal shaft portions 16*a* and 20*a*, and eccentric shaft portions 16*b*, 20*b* and 20*c* are made parallel therewith, respectively.

In the press machine 10, the moving body 44 can not be moved unless the worm wheel 46 is rotated. The second crankshaft 20 can turn or swing about its rotational axis, but it is allowed to move neither in the up and down directions, nor in the front and back directions, nor in the right and left directions.

Therefore, as the first crankshaft 16 is turned, the lever 32 swings about the pivot 36, which in turn causes both of levers 32 and 34 to perform their bending-stretching motion. With this motion, the second crankshaft 20 begins to swing about its rotational axis, so that the connecting body 40 is moved in the up and down directions, swinging about the pivot 42. As a result, the rods 24 and the slide 22 are moved together in the up and down directions.

When the stroke of the slide motion in the up and down directions is adjusted, the sprocket 50 is turned. As described in the above, as the worm 48 and the worm wheel 46 are turned with the turning of the sprocket, the moving body 44 having the male screw 52 mating with the threaded hole of the worm wheel 46 is moved either upward or downward, thereby changing the height of the pivot 36.

If the height of the pivot 36 is changed, the range of the swinging motion about the pivot 36 performed by levers 32 and 34 is changed, and the bending-stretching angle of levers 32 and 34 is also changed. Thus, the position of the swinging range and the swinging angle of the second crankshaft 20 are changed. As a result, the position of the swing range and the swinging angle of the connecting body 40 about the pivot 42 are also changed, thereby changing the stroke of the rods 24 and the slide 22.

As described in the above, the moving body 44 can not be moved unless the worm wheel is turned. Therefore, the point at which the lever 32 and the position adjusting device 38 are connected with each other through the pivot 36, functions as a first pivot which is not moved by the bending-stretching motion of the levers 32 and 34. Contrary to this, the first eccentric shaft portion 20*b* is displaced as the second crankshaft 20 is rotated or swung. Therefore, the point at which the lever 34 and the first eccentric shaft portion 20*b* are connected with each other, functions as a second pivot which is moved by the bending-stretching motion of the levers 32 and 34.

Figure 2:
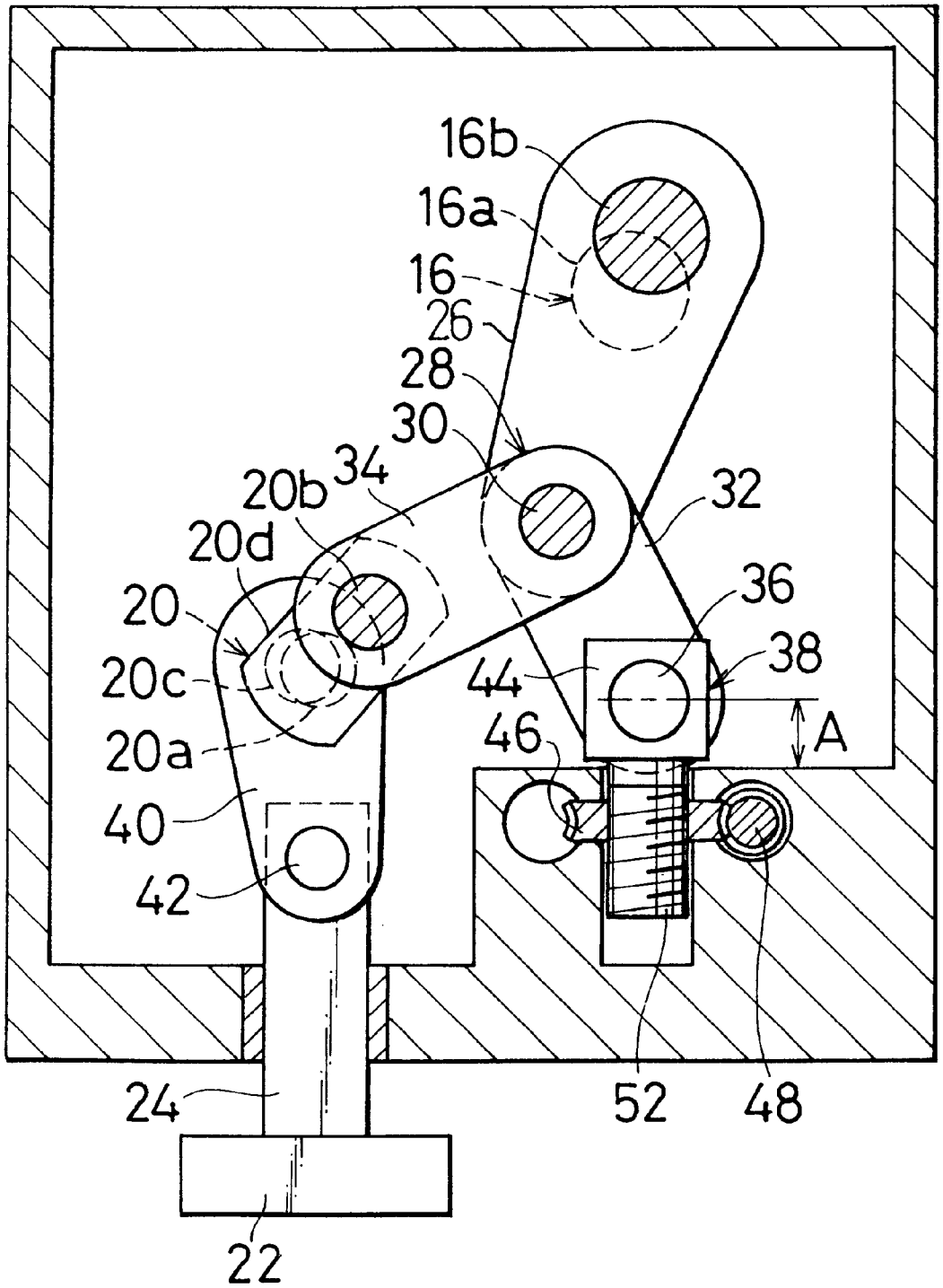
FIG. 2 is a sectional view taken substantially on line 2—2 of FIG. 1, wherein a frame portion is omitted in part.
Figure 3:
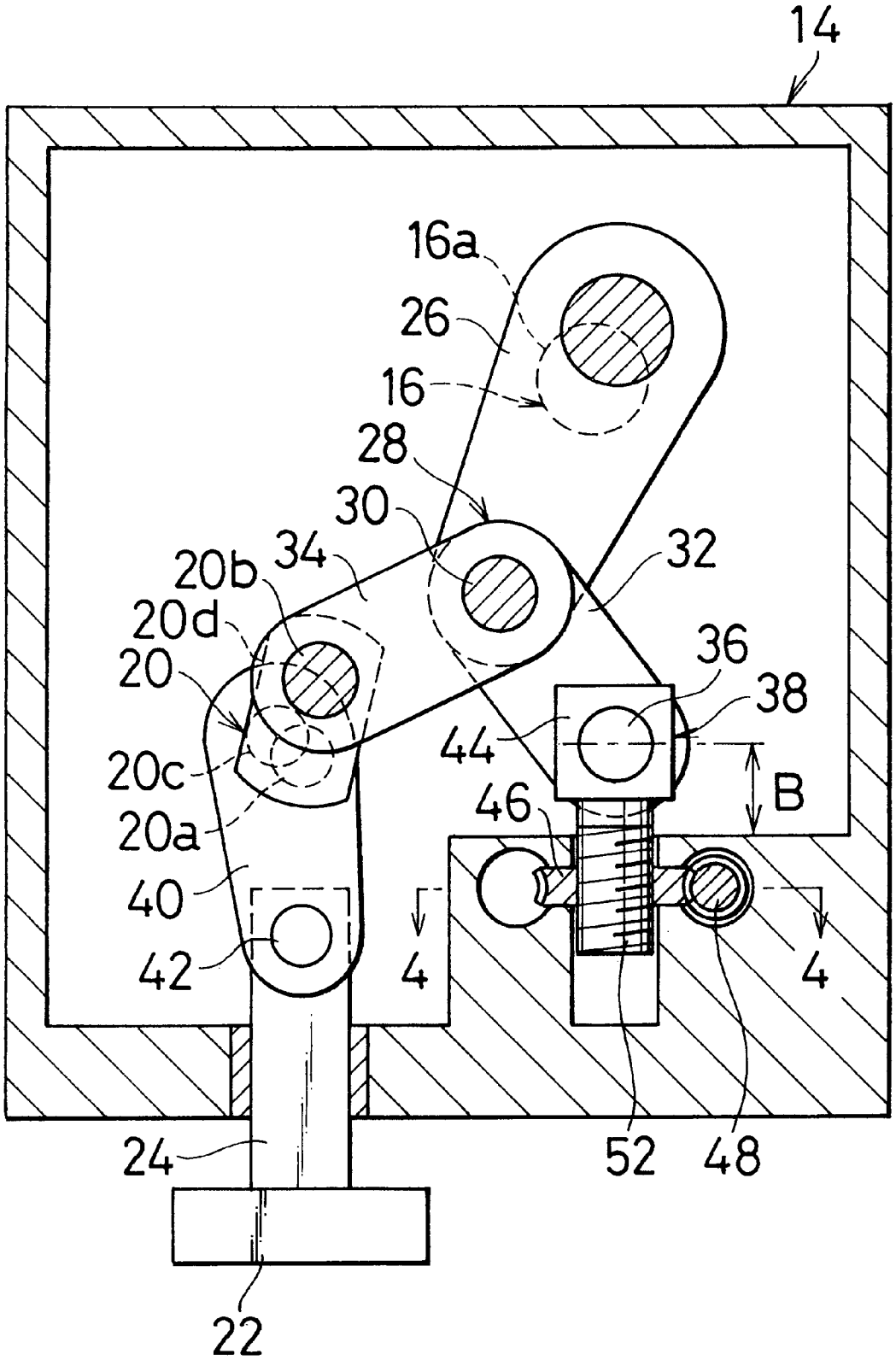
FIG. 3 is a sectional view similar to FIG. 2, indicating a state that a first pivot is moved upward.
Figure 4:
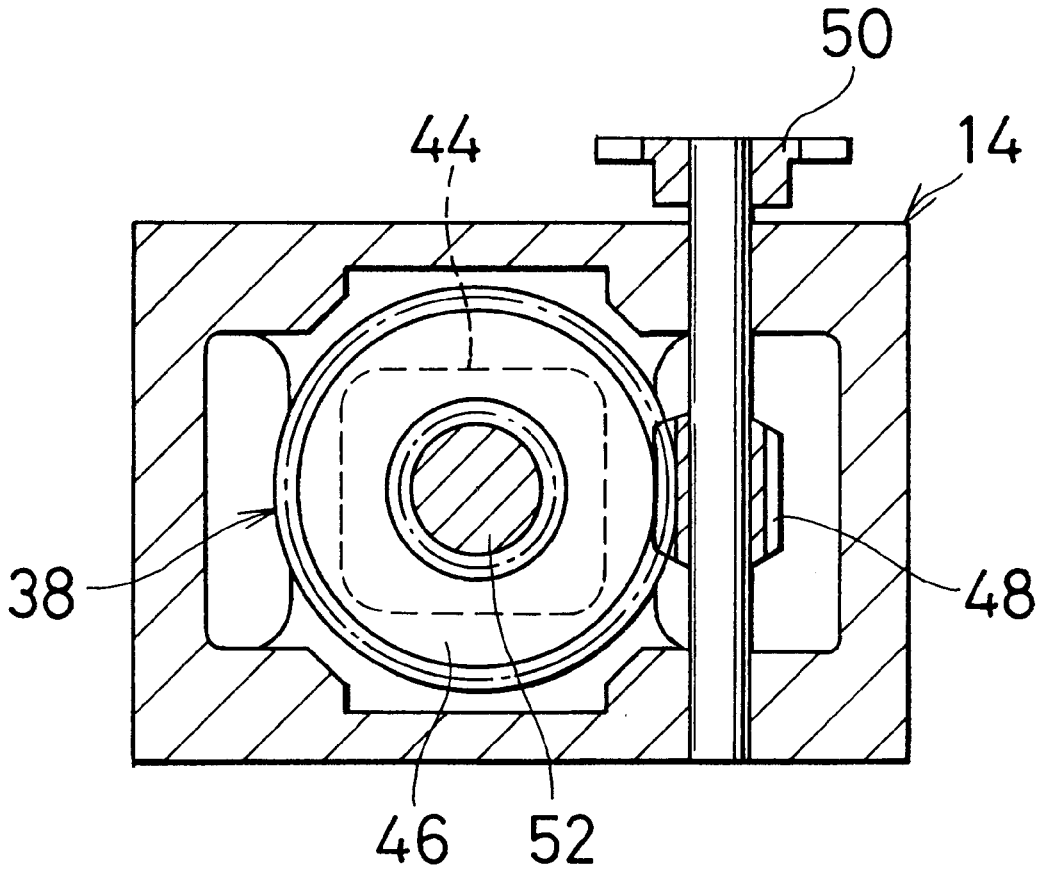
FIG. 4 is a sectional view taken along line 4—4 of FIG. 3.
Figure 5A:
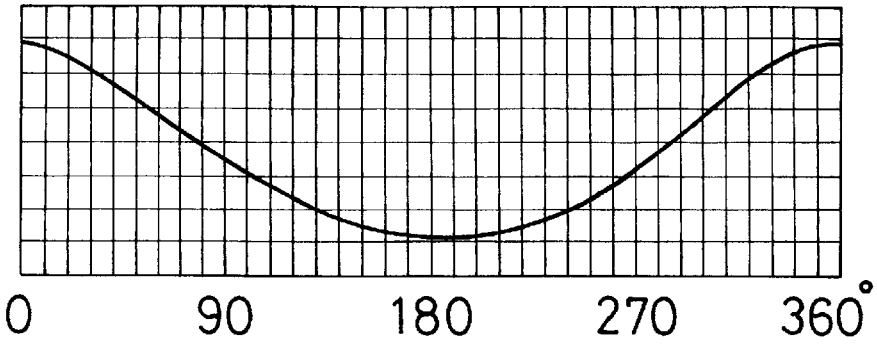
FIGS. 5(A) through 5(C) are graphs indicating slide stroke curves under different conditions.
Figure 5B:
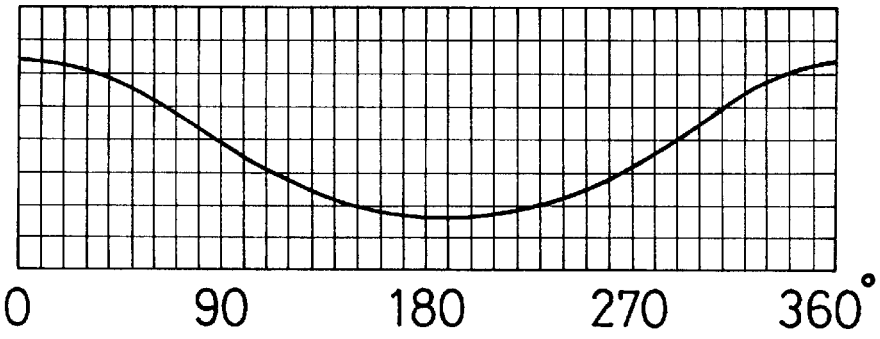
Figure 5C:
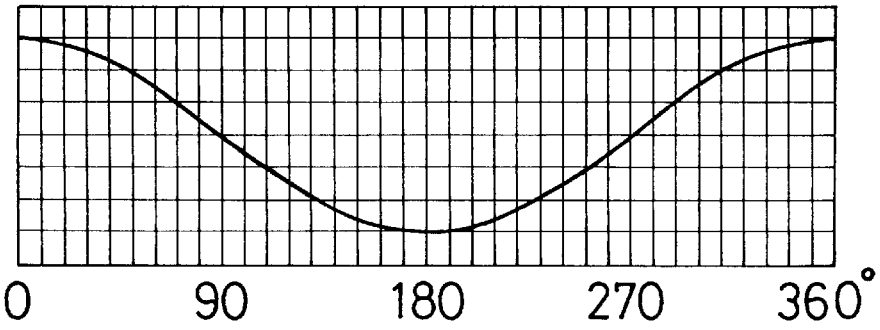

FIG. 5(A) shows a stroke curve of the slide motion when the height of the first pivot is set as A as shown in FIG. 2. FIG. 5(B) shows a stroke curve of the slide motion when the height of the first pivot is set as B as shown in FIG. 3. FIG. 5(C) shows a stroke curve of the slide motion in an ordinary crank press machine. From these FIGS. 5(A) through 5(C), it will be understood that the higher the height of the first pivot is set, the longer the stroke of the slide 22 is made.

As described in the above, if the stroke of the slide 22 moving up and down is made variable, the stroke of the slide 22 can be adjusted and set to an optimum value in compliance with the sort of the press processing, for instance, to meet the required press processing speed. As a result, it becomes possible to have the same single press machine adapted to different kinds of press pressings.

In the above embodiment, it is not always needed for the link 26 to be connected with both of levers 32 and 34. The link 26 may be connected with either the lever 32 or the lever 34. Also, the first and second crankshafts may be connected by means of two or more connection mechanisms. Further, the first crankshaft may be connected with two or more second crankshafts. In this case, the first pivot and the position adjusting device may be commonly used by or be separately prepared for every connection mechanism.

In the above embodiment, the crankshaft is rotated through the flywheel. However, the flywheel is not always an inevitable element. Alternatively, the crankshaft may be rotated directly or through a suitable means such as a reduction gear by means of an electric motor such as a servomotor.

In the above embodiment, the position adjusting device 38 is constructed such that the moving body 44 can be moved upward and downward. However, it may be constructed such that the moving body 44 can be moved in the right and left directions i.e. in the horizontal direction in FIGS. 2 and 3. Also, the position adjusting device may be constructed as a mechanism using a member other than the rotating body having the threaded hole.

Figure 6:
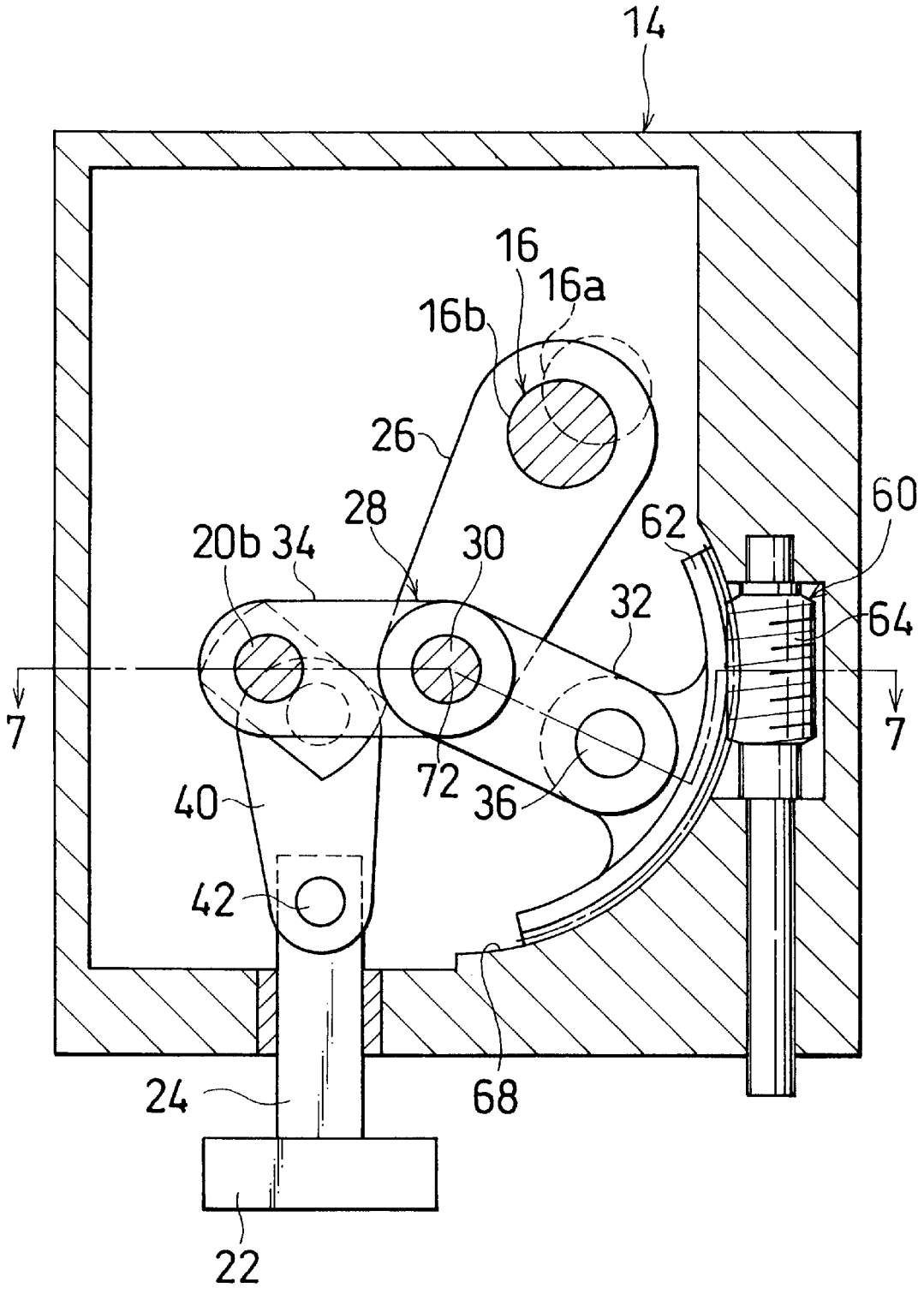
FIG. 6 is an illustration showing another embodiment of a position adjusting device according to the invention.
Figure 7:
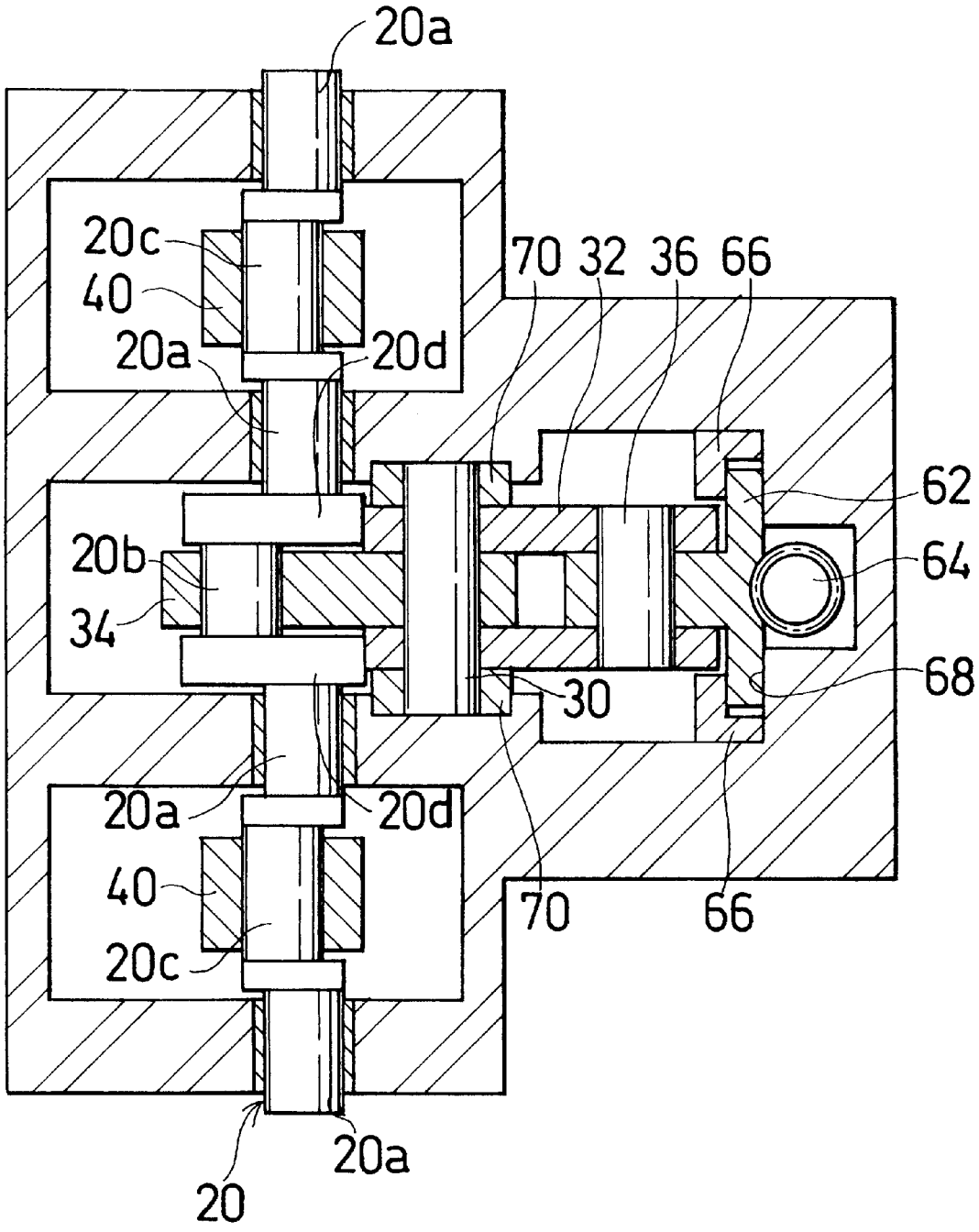
FIG. 7 is a sectional view taken along line 7—7 of FIG. 6

Now, referring to FIGS. 6 and 7, there is indicated another position adjusting device 60 according to the invention. The position adjusting device 60 includes a fan- or arc-shaped external gear 62 which is pivotally connected, through a pivot 36, with the lever 32 of the connection mechanism 28, and a rotation mechanism 64 which is in mesh with the external gear 62 so as to rotate it. The external gear 62 functions as a rotating body.

The external gear 62 is set up on the frame 14 by means of a plurality of arc-shaped guides or auxiliary members 66 such that the pivotal joint (first pivot) to the lever 32 is allowed to angularly rotate along such a circular arc that is imaginarily drawn about another axis 72 extending in one direction (at right angles to the drawing). The rotation mechanism 64 is constructed in the form of a worm in mesh with the external gear 62 and is rotatively supported by the frame 14 such that it can be rotated by hand and/or by a driving means such as an electric motor.

The external gear 62 has an external peripheral surface which extends zonally. On this peripheral surface, there are provided a plurality of gear teeth which are aligned along the center line running through the mid-width of the peripheral surface and are to be in mesh with the rotation mechanism. Both side edges of the external peripheral surface are brought into contact with an inner face 68 in the form of a circular arc and an auxiliary member 66, both of which are provided on the frame 14. The rotational center of the external gear 62 is set on the joint of both levers 32 and 34, in other words, the axis of the pivot 30 (or in its vicinity).

In the position adjusting device 60, as the rotation mechanism 64 is rotated, the external gear 62 angularly moves along the circular arc shaped inner face 68 and the auxiliary member 66, so that the lever 32, the external gear 62, and the pivotal joint i.e. first pivot (center of pivot 36) come to angularly move along the imaginary circular arc whose center is the axis 72.

As a result of the above-mentioned movement of the rotation mechanism 64, the pivotal joint (axis of pivot 30) of the levers 26, 32 and 34 is moved, so that the bent position and bent angle between the levers 32 and 34 and between the levers 26 and 32 are respectively changed with the rotation of the crankshaft 16, thereby changing the stroke of the slide motion in the up and down directions. Therefore, the stroke of the slide motion in the up and down directions can be finely adjusted by turning the rotation mechanism 64. (47)

As in the example shown in FIGS. 6 and 7, under the situation where the link 26 is pivotally connected with the joint of both levers 32 and 34 (or with its vicinity) and the slide 22 is set on the position of the lower dead point, if the external gear 62 is angularly rotated by the rotation mechanism 64, the external gear 62 is angularly rotated about the joint of both levers 32 and 34, and the bent position and bent angle of both levers 32 and 34 are changed. With this, the swinging position and swinging angle of the second crankshaft 20 is changed with the rotation of the first crankshaft 16, but there is caused little change not only on the position of the joint between both levers 32 and 34 but also on the position of the lower dead point. As a result, it becomes possible not only to finely adjust the stroke of the slide motion in the up and down directions, but also to keep the position of the lower dead point almost unchanged even when the value of the stroke is changed.

Alternatively, the link 26 may be connected with the connection mechanism 28 at a suitable point apart from the joint of the levers 32 and 34 (i.e. axis 72 of the pivot 30), for instance a point between pivots 30 and 36, a point on a first imaginary line which connects the axis of the pivot 30 with that of the pivot 36, a point on a line which extends from the first imaginary line, a point between the pivot 30 and the eccentric shaft portion 20*b*, and the pivot 30, a point on a second imaginary line connecting the axes of the pivot 30 and the eccentric shaft portion 20*b* with the axis of the pivot 36, or a point on a line which extends from the second imaginary line.

If the link 26 is connected with the connection mechanism 28 by any one of the ways as described above, the rotation mechanism 64 may have the external gear 62 angularly rotated about a point apart from the joint center 72 of levers 32 and 34, so that the center of the levers 26 and 32 may be similarly moved. As a result, despite that the stroke of the slide 22 moving up and down might be changed, the positional change in the lower dead point can be made smaller even when the value of the stroke is changed.

In the position adjusting device 60, the external gear 62 may be replaced by a flat plate-like rotating body, for instance, an internal gear, a ratchet wheel, a sprocket, a timing pulley and so forth. Such flat rotating body may be pivotally connected with the connection mechanism 28 through a point other than the center of rotation thereof. Also, depending on the kind of the rotating body, the worm may be replaced by a rotation mechanism including other members, for instance, a ratchet, a chain, a timing pulley, a timing belt and so forth.

The invention is not limited to the embodiments as described in the above. For instance, the invention is applicable to a press machine which is provided with a balancing weight. Therefore, it will be apparent to those skilled in the art that changes and modifications can be made without departing from the principle and spirit of the invention and the scope as defined in the appended claims.

What is claimed is:

1. A press machine comprising a frame;

a first crankshaft rotated by a driving source;

a connection mechanism having a pair of levers pivotally connected with each other so as to perform a bending-stretching motion, one of the levers having a first pivot not moved by said bending-stretching motion and the other having a second pivot moved by said bending-stretching motion;

a link for linking said first crankshaft with said connection mechanism so as to make said pair of levers perform an amount of bending-stretching motion with rotation of said first crankshaft;

a second crankshaft having a first eccentric shaft portion connected with said second pivot and a second eccentric shaft portion connected with a slide; and a position adjusting device connected to the first pivot and movable for adjusting the position of said first pivot thereby to change the amount of bending-stretching motion.

2. A press machine as claimed in claim 1, wherein said position adjusting device includes a circular plate rotating body provided with a female threaded hole and disposed on said frame so as to rotate about an axis without otherwise moving relative to the axis;

a rotation mechanism for rotating said rotating body; and a moving body disposed on said frame, said moving body being connected with said first pivot and having a male threaded portion mating with said female threaded hole.

3. A press machine as claimed in claim 1, wherein said position adjusting device includes a rotating body pivotally connected at a joint with said connection mechanism such that the joint to said connection mechanism is rotatable about an axis extending in a direction parallel to an axis pivotally connecting both of said levers; and a rotation mechanism for rotating said rotating body.

4. A press machine as claimed in claim 1 wherein an eccentric shaft portion of said first crankshaft is connected with said connection mechanism to transmit rotary motion of said first crankshaft to said connection mechanism, wherein said link is pivotally connected with said connection mechanism through one of a joint between both levers of said connection mechanism and a point apart from said joint, said position adjusting device including a rotating body pivotally connected with at least one of the levers of said connection mechanism and a rotation mechanism for rotating said rotating body, and wherein a rotation center of said rotating body is placed at a point such that the rotating body rotates about the joint of both said levers.

5. A press machine as claimed in claim 1, wherein said connection mechanism includes a connecting piece that pivotally connects a joint of its both levers with an eccentric shaft portion of said first crankshaft.

6. A press machine as claimed in claim 1, wherein said one lever is pivotally connected with said position adjusting device through said first pivot.

7. A press machine as claimed in claim 1 further comprising a link for connecting an eccentric shaft portion of said first crankshaft with said connection mechanism to transmit rotary motion of said first crankshaft to said connection mechanism.

8. A press machine as claimed in claim 1 further comprising one or more rods extended in a vertical direction and arranged on said frame so as to be movable in the vertical direction but not movable in a horizontal direction, and a connecting body pivotally connected with said rods as well as with the second eccentric shaft portion of said second crankshaft, the slide being connected with said rods at the lower ends thereof.

* * * * *